United States Patent [19]

Tsuge et al.

[11] Patent Number: 4,485,707

[45] Date of Patent: Dec. 4, 1984

[54] METHOD OF CONVEYING SHEETS, AND BLANKING DIE ASSEMBLY IN A PINCH PRESS

[75] Inventors: Eiji Tsuge; Takeshi Chujo, both of Toyota, Japan

[73] Assignee: Toyota Jidosha Kabushiki Kaisha, Toyota, Japan

[21] Appl. No.: 454,095

[22] Filed: Dec. 28, 1982

[30] Foreign Application Priority Data

Sep. 4, 1981 [JP] Japan ..... 56-131717

[51] Int. Cl.[3] ..... B26D 7/18

[52] U.S. Cl. ..... 83/82; 83/156; 83/620

[58] Field of Search ..... 83/23, 79, 80, 110, 83/111, 112, 129, 156, 620, 622, 81, 82

[56] References Cited

U.S. PATENT DOCUMENTS 2,307,594 1/1943 Lee ..... 83/82 X 2,436,192 2/1948 Braun ..... 83/156

*Primary Examiner*—James M. Meister

*Attorney, Agent, or Firm*—Cushman, Darby & Cushman

[57] ABSTRACT

In a blanking die assembly for use with a punch press for cutting a sheet material along two spaced apart lines in each striking stroke, a conveyor is provided for conveying the upstream blanked sheet piece 17 out of the press, which comprises upper rolls 8 driven by a motor between upstream and downstream cutter units 3, 4; 5, 6, cooperating vertically movable lower rolls 9, and a control 12, 24, 25, 26, 27, 28 is provided for controlling the position of the lower rolls so that the upstream blanked sheet piece is sandwiched between the rolls 8, 9 to be conveyed after the striking stroke.

4 Claims, 4 Drawing Figures

METHOD OF CONVEYING SHEETS, AND BLANKING DIE ASSEMBLY IN A PINCH PRESS

BACKGROUND OF THE INVENTION

1. Field of the Invention

The present invention relates to a method of conveying blanked sheet pieces out of a punch press provided with a blanking die assembly having upstream cutter units and downstream cutter units for cutting across an elongated sheet material fed into the press along two lines spaced apart in the direction of feed in each striking stroke of the press, thereby blanking out simultaneously two sheet pieces from the elongated sheet material in each striking stroke.

The present invention relates also to a blanking die assembly of such type.

2. Description of Prior Art

In a punch press associated with a conventional blanking die assembly of this type, one of the two blanked out sheet pieces or workpieces located downstream with respect to the other is conveyed downstream out of the press to a sheet stacker, while the other upstream located sheet piece is conveyed transversely out of the press to another sheet stacker. This is because there has been no suitable method of transporting the upstream located workpiece in a downstream direction. Stated otherwise, the prior art apparatus associated with a blanking die assembly of this type has no means for forcibly transferring workpieces of predetermined size in a short period of time. The foregoing conventional transporting method has suffered from two problems. The first problem is that a sheet stacker has to be installed outside the direction of feed in addition to the one located downstream with respect to the direction of the feed. The second problem is that since the apparatus is arranged such that the upstream blanked out workpiece falls freely onto a conveyor which transversely transports it out of the press, it is impossible to provide means at the blanking-out location for supporting the sheet material from below, as with skid bars. Therefore, a magnetic roll or the like which will attract the sheet material must be attached to the upper die base to support the leading end portion of the sheet material when the sheet material is fed into the press. This arrangement results in unstable feeding and is an obstacle to speeding up the operation.

SUMMARY OF THE INVENTION

It is therefore an object of the present invention to provide a method of conveying blanked sheet pieces out of a punch press provided with a blanking die assembly of the above mentioned type, which allows stable feeding of a sheet material to be cut in the press.

Another object of the present invention is to provide a method of conveying blanked out sheet pieces out of the press, in which only a single sheet stacker is required for accomodating the sheet pieces near the press.

Another object of the present invention is to provide a blanking die assembly of the above-mentioned type, which allows stable feeding of the sheet material to be cut in the press.

A further object of the present invention is to provide a blanking die assembly of this type, which requires only a single attendant sheet stacker for accomodating the sheet pieces conveyed out of the press.

In order to achieve the above objects, the method according to the present invention includes the step of conveying downstream the upstream blanked sheet piece out of the press.

The blanking die assembly according to the present invention is characterized by upper rolls disposed between upstream and downstream cutter units and driven by a motor, lower rolls vertically movably disposed in confronting relation to the upper rolls, and a control device for controlling vertical movement of the lower rolls in order to transport a blanked upstream workpiece in a downstream direction while sandwiched between the upper and lower rolls.

BRIEF DESCRIPTION OF DRAWINGS

Other objects, features and advantages of the present invention will now be described, by way of example, with reference to the accompanying drawings which show one preferred embodiment of the present invention, and in which.

DETAILED DESCRIPTION OF THE PREFERRED EMBODIMENT

Figure 1:
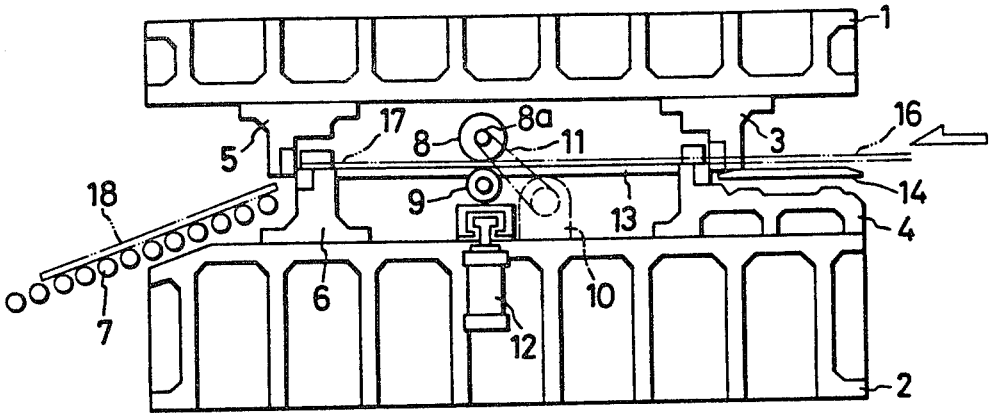
FIG. 1 is a schematic front elevational view of the embodiment of the blanking die assembly according to the present invention.

Referring now to FIG. 1, the blanking die assembly has an upper die base 1 and a lower die base 2 fastened to a slide and a bolster, respectively, of a punch press (not shown).

An upstream upper cutter unit 3 is mounted on the upper die base 1, and a cooperating upstream lower cutter unit 4 is mounted on the lower die base 2. Cooperating downstream upper and lower cutter units 5, 6 are mounted respectively on the upper and lower die bases 1, 2. A workpiece transporting roller conveyor chute 7 is fixed to the lower die base 2. Upper workpiece transporting rolls 8 are fixedly mounted on a common shaft **8*a* which is located between the upstream and downstream cutter units. The shaft 8*a* is supported by bearings 8*b* on the lower die base 2 and is driven to rotate the upper rolls 8 by a drive motor 10 through a drive chain 11. Lower rolls 9 mounted on a shaft 9*a* supported by bearings 15 are positioned in confronting relation to the upper rolls 8. The bearings 15, together with the shaft 9*a* and rolls 9, are vertically movable by a pneumatic cylinder actuator 12 carried on the lower die base 2, and guided for such movement by guide rods 23 slidable in suitable guides as shown schematically in FIGS. 1 and 3. Intermediate skid bars 13 and upstream skid bars 14 are supported on the lower die base 2. Designated at 16 is a leading end portion of a sheet material fed from a coil feeder (not shown), at 17 an upstream blanked workpiece, and at 18 a downstream blanked workpiece as it is transported on the roller conveyor chute 7**.

Figure 2:
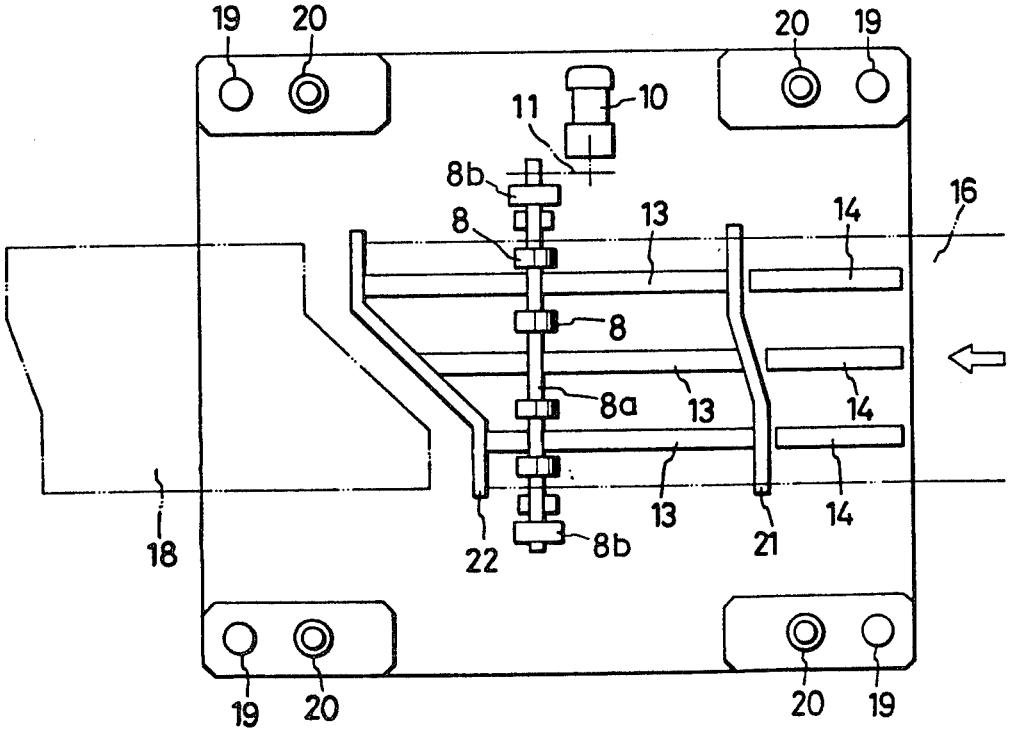
FIG. 2 is a schematic plan view of the blanking die assembly, in which the upper die base is omitted.
Figure 3:
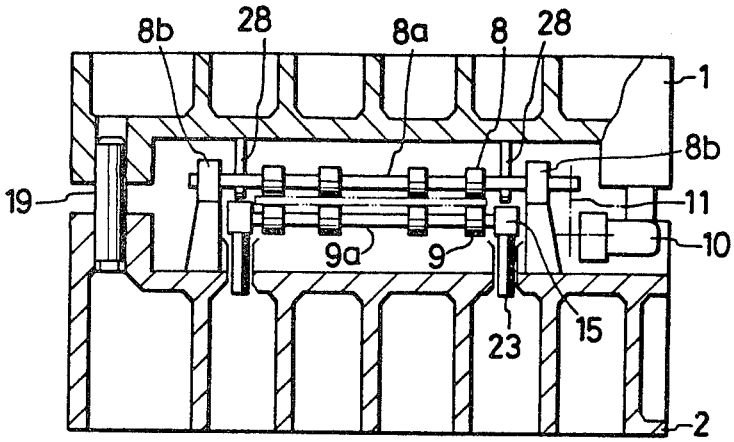
FIG. 3 is a schematic vertical cross-sectional view of the blanking die assembly.

As shown in FIGS. 2 and 3, guide posts 19 are fixed to the upper die base 1, and upper die maintaining blocks 20 are fixed to the lower die base 2. Upstream and downstream lower die cutting edges 21, 22 are attached respectively to the upstream and downstream lower cutter units 4, 6.

As shown in FIG. 3, advance presser pins 28 are secured to the upper die base 1 for engaging the bearings 15 and depressing the lower rolls 9 when the upper die base is lowered.

Figure 4:
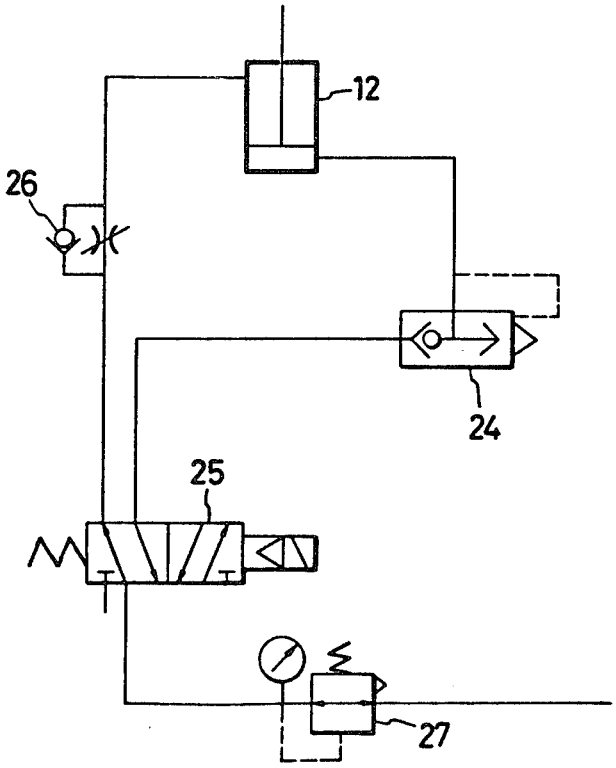
FIG. 4 is a diagram showing a pneumatic circuit in the control system for lower rolls.

Designated in FIG. 4 at 24 is a quick exhaust valve, at 25 a directional control valve, at 26 a restrictor, and at 27 a regulator.

Operation of the foregoing arrangement will now be described. In FIG. 1, the downstream blanked workpiece 18 is transported downstream immediately by the roller conveyor chute 7 in the conventional manner. The method by which the upstream blanked workpiece 17 is transferred out will now be described. The upper rolls 8 are continuously driven by the drive motor 10 to rotate in the direction in which to transfer out the workpiece. The lower rolls 9, when the upper die base 1 comes near the lowermost position, are pressed downwardly by the advance presser pins 28 as shown in FIG. 3. In this lowermost position, the upstream workpiece 17 is blanked. As the upper die base 1 moves upwardly with the press slide, the lower rolls 9 are raised by the pneumatic cylinder actuator 12, following the advance presser pins 28. When the downstream upper cutter unit 5 is spaced from the downstream lower cutter unit 6 by a gap large enough to allow transfer of the workpiece therethrough, the upstream workpiece 17 is sandwiched between the upper and lower rolls 8, 9, and is transferred downstream rapidly by the rotating upper rolls 8. Thereafter, the sheet material 16 is introduced by the coil feeder downstream into the die assembly approximately at a press crank angle of 270°. As shown in FIG. 4, the regulator 27 is supplied at this time with air under suitable pressure, e.g., 5 kg/cm$^2$. The piston of the pneumatic cylinder actuator 12 is immediately lowered by the directional control valve 25 and the quick exhaust valve 24 in response to a signal from the press machine, thereby lowering the lower rolls 9 to allow passage of the coil 16 therepast.

With the present invention, the upper rolls which are driven by the motor are disposed between the upstream and downstream cutter units, and the lower rolls which are vertically movable are positioned in confronting relation to the upper rolls, the upper and lower rolls being operable together to quickly transport the upstream workpiece which has been blanked. The above arrangement requires only a single sheet stacker disposed downstream of the press. In addition, the sheet workpieces that have been blanked can rapidly and easily be transferred downstream out of the die assembly.

The present invention is highly advantageous in that stable feeding of the sheet material and blanked sheet pieces can be assured.

What is claimed is:

1. A blanking die assembly in a punch press, having an upper die base and a lower die base;

upstream cutter units and downstream cutter units supported by said die bases for cutting a sheet material simultaneously along two lines spaced apart from each other in the direction of feed of the sheet material;

means for conveying downstream an upstream blanked sheet piece from between said upstream and downstream cutter units and out of said press, said conveyor means including motor-driven upper rolls disposed between said upstream and downstream cutter units and supported by said lower die base, lower rolls vertically movably mounted to said lower die base in confronting relation to said upper rolls; and control means for controlling the position of said lower rolls so that said upstream blanked sheet piece is sandwiched between said upper and lower rolls to be conveyed downstream after the striking stroke of said press.

2. A blanking die assembly as claimed in claim 1, in which said lower rolls are rotatably mounted on a common shaft, and in which said control means includes a pneumatic lift mechanism urging said shaft upwardly, and at least one mechanical structure fixedly mounted on said upper die base to depress said shaft in the striking stroke of said press.

3. A blanking die assembly as claimed in claim 1, in which skid bars are fixed to said lower die base for supporting the sheet material between said upstream cutter units and said downstream cutter units.

4. A blanking die assembly as claimed in claim 2, in which skid bars are fixed to said lower die base for supporting the sheet material between said upstream cutter units and said downstream cutter units.

* * * * *